US006931769B2

(12) United States Patent
Mahoney et al.

(10) Patent No.: US 6,931,769 B2
(45) Date of Patent: Aug. 23, 2005

(54) SNOWSHOE PIVOT AXLE PAD

(75) Inventors: Francis E. Mahoney, Barre Town, VT (US); Daniel P. Kiniry, Barre Town, VT (US)

(73) Assignee: K2 Snowshoes, Inc., Carlsbad, CA (US)

( * ) Notice: Subject to any disclaimer, the term of this patent is extended or adjusted under 35 U.S.C. 154(b) by 0 days.

(21) Appl. No.: 10/401,424

(22) Filed: Mar. 28, 2003

(65) Prior Publication Data

US 2004/0187355 A1 Sep. 30, 2004

(51) Int. Cl.[7] ..... A43B 5/04; A43B 5/16
(52) U.S. Cl. ..... 36/122; 36/125
(58) Field of Search ..... 36/122, 123, 124, 36/125

(56) References Cited

U.S. PATENT DOCUMENTS

| | | | | | |
|---|---|---|---|---|---|
| RE25,472 | E | * | 11/1963 | Howe | 36/125 |
| 4,161,071 | A | * | 7/1979 | Maul | 36/125 |
| 4,720,927 | A | | 1/1988 | Abegg | |
| 5,259,128 | A | * | 11/1993 | Howell | 36/122 |
| 5,493,794 | A | * | 2/1996 | McKenzie et al. | 36/122 |
| 5,517,772 | A | * | 5/1996 | Anderson | 36/122 |
| 5,787,612 | A | * | 8/1998 | Mahoney et al. | 36/124 |
| 5,809,667 | A | * | 9/1998 | Liautaud | 36/122 |
| 5,809,668 | A | * | 9/1998 | Kiniry et al. | 36/122 |
| 5,829,173 | A | * | 11/1998 | Svetlik et al. | 36/124 |
| 5,946,829 | A | | 9/1999 | Quellais et al. | |
| 6,003,249 | A | | 12/1999 | Watson | |
| 6,105,281 | A | * | 8/2000 | Wing et al. | 36/122 |
| 6,112,436 | A | | 9/2000 | Quellais | |
| 6,163,984 | A | | 12/2000 | Faber et al. | |
| 6,178,666 | B1 | * | 1/2001 | Kiniry et al. | 36/125 |
| 2003/0126764 | A1 | * | 7/2003 | Emerson et al. | 36/122 |

* cited by examiner

*Primary Examiner*—Anthony Stashick
(74) *Attorney, Agent, or Firm*—McCormick Paulding & Huber LLP

(57) ABSTRACT

A snowshoe has a frame and a pivot axle assembly extending across an opening in the frame for pivotally supporting a boot binding assembly for limited front and rear rotation, a resilient pad is disposed between the pivot axle assembly and the boot binding assembly for permitting frontal plane, side to side movement of the boot binding assembly.

6 Claims, 7 Drawing Sheets

SNOWSHOE PIVOT AXLE PAD

BACKGROUND OF THE INVENTION

1. Field of the Invention

The invention relates to snowshoes and, more particularly, to the fixed pivot axle or pivot rod for such showshoes.

2. Description of the Related Art

The snowshoe has existed for a few thousand years. Until a decade ago, showshoes use was primarily utilitarian (i.e., hunters, forestry, exploration, etc.). The original materials of wood and animal hide have been replaced with lightweight metals, plastics, and composites, and the major consumer markets have become recreational in nature.

Snowshoes add a platform to the foot sole to increase the size of the footprint. The larger the footprint, the less one is likely to sink below the surface of the snow. Snowshoes have a tendency to be cumbersome, and impair the natural human locomotion of walking. Recreational consumers demand that showshoes be comfortable to use, and allow natural body movements.

Innovations during the past fifteen years have improved the human/snowshoe interface. Most manufacturers have developed designs which allow sagittal plane rotation, or forward or rearward movement of the foot; however, they have restricted the frontal plane rotation, or transverse, side to side movement of the foot, for better control.

Most prior art showshoe designs use a fixed pivot axle to achieve sagittal plane rotation. These systems make no provision for frontal plane variations. The effect is similar to operating a vehicle without springs.

BRIEF SUMMARY OF THE INVENTION

When walking on snowshoes, irregularities in the snow pack cause a step to step variation in the frontal plane surface, with frontal plane rotation being similar to "roll" in an aircraft. The human anatomy can accommodate angular variations of up to 10°.

The snowshoe suspension system of the invention allows additional "roll" from the plane of the fixed pivot rod axis, wherefore the activity is less tiring, with less impact on the body.

A second advantage of frontal plane rotation is the instance wherein one walks in a direction perpendicular to a slope, called "traverse", since the snowshoe frame assumes the angle of the slope. The pad of the invention permits frontal plane rotation which allows the lower leg to be nearer to vertical, whereby less stress is placed on the ankle.

Snowshoes are usually fitted with a fixed, transversely-extending, pivot axle or rod upon which a snowshoe binding is pivotally mounted for limited front to rear rotation. This design is the most economical to produce and is very popular with European snowshoes.

The pad of the invention is disposed between the snowshoe binding and its fixed pivot axle or rod, which has a toe crampon depending therefrom. The pad functions as a "shock absorber" and provides for varying degrees of frontal, or side to side rotation of the snowshoe binding and crampon relative to the fixed pivot axle. The pad allows rotation angles of varying degrees in either left or right directions.

The pad hereof is preferably molded from resilient material such as rubber, or a thermoplastic olyefin (TPO) or a thermoplastic rubber (TPR), or similar elastomers.

DETAILED DESCRIPTION OF THE INVENTION

Figure 1:
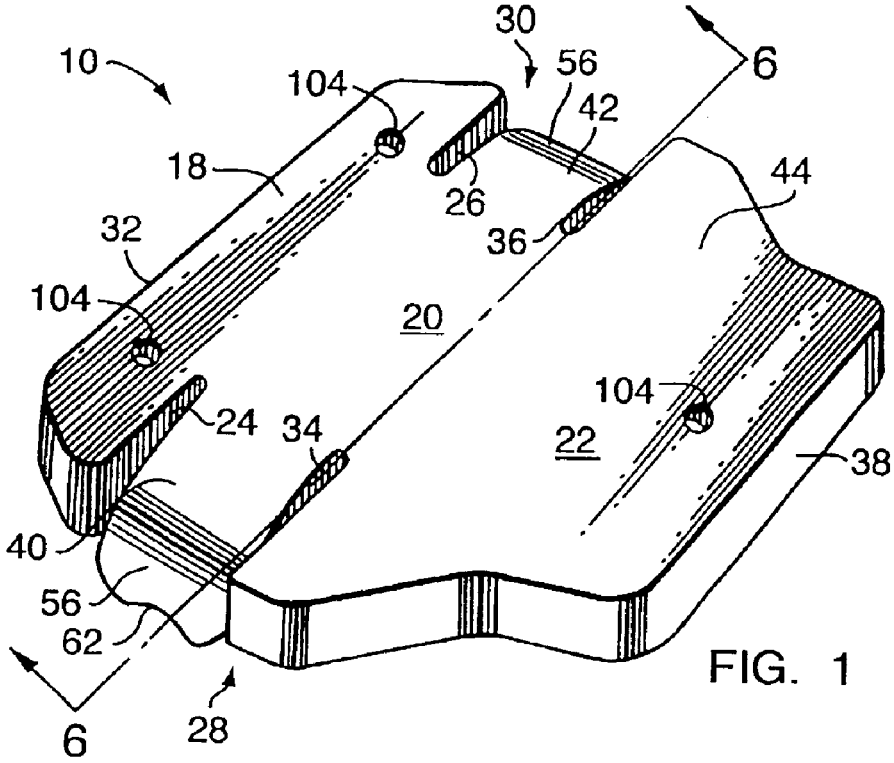
FIG. 1 is a top perspective view of a snowshoe pivot axle pad embodying the invention.
Figure 9:
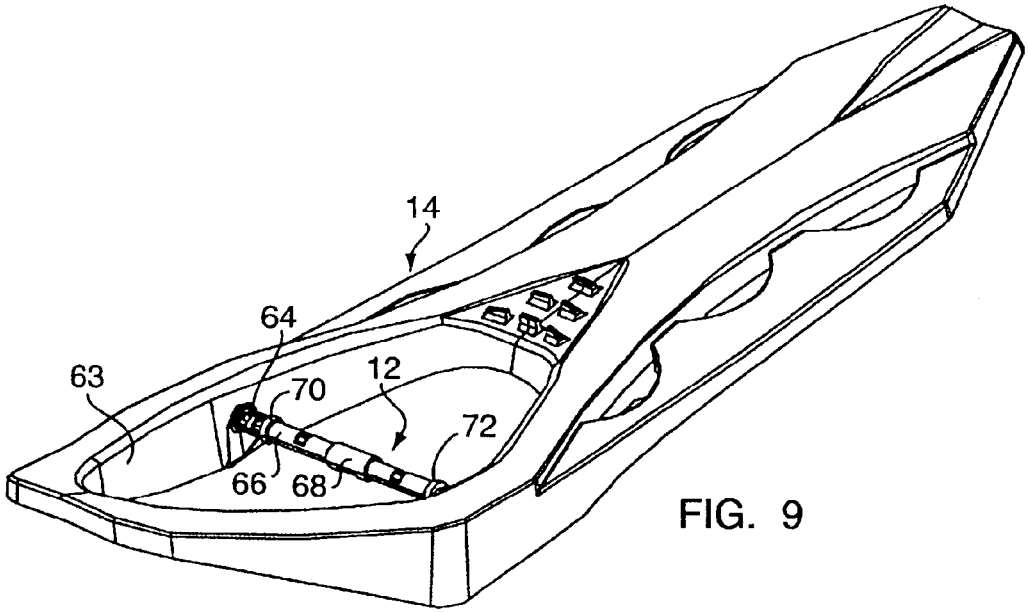
FIG. 9 is a top perspective view of the snowshoe of FIG. 7 with the snowshoe binding assembly removed for clarity of illustration.
Figure 15:
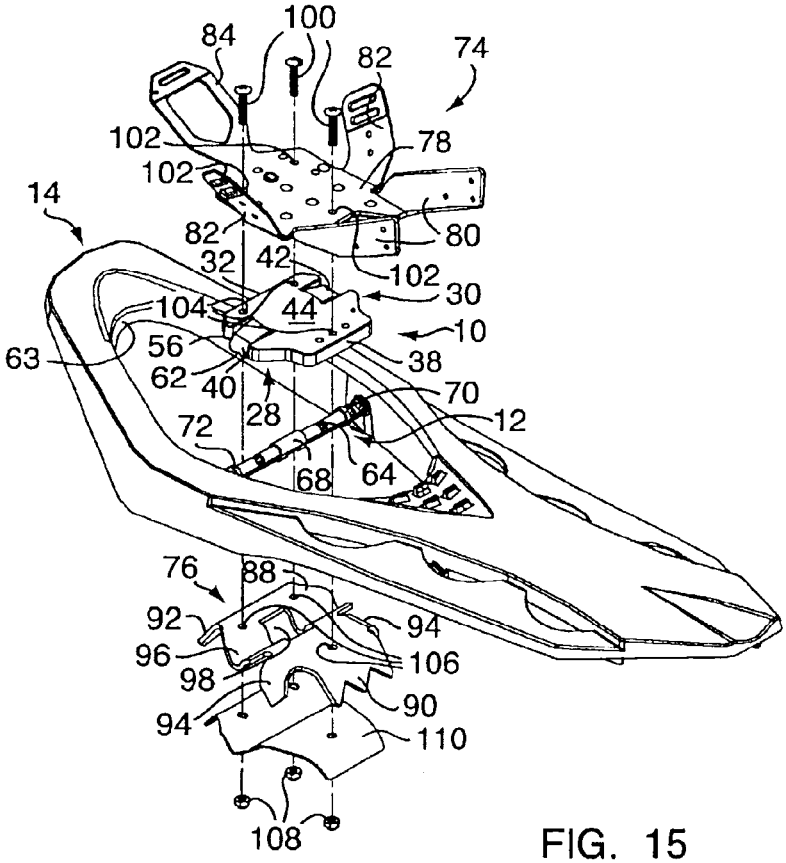
FIG. 15 is an exploded top perspective view of the snowshoe of FIG. 7.

Referring to FIGS. 1, 9 and 15, a pivot axle or pivot rod pad, generally indicating by 10, embodying the invention, is used in conjunction with a pivot axle or pivot rod assembly, generally indicated by 12, which is fixed to a snowshoe, generally indicated by 14, with the pivot rod pad supporting a snowshoe binding assembly, generally indicated by 16, mounted for pivotal movement relative to pivot rod assembly 12 in a manner to be described.

As best seen in FIGS. 1–6, pivot pad 10, which is preferably molded from resilient material, such as rubber, or a thermoplastic olyefin (TPO), or a thermoplastic rubber (TPR), or any similar elastomers, is relatively thin in elevation, is somewhat rectangular in plan, and includes integral, contiguous, forward, intermediate and rearward portions 18, 20 and 22, respectively.

Intermediate portion 20 of the pivot rod pad 10 is separated from forward portion 18 by a first pair of axially aligned slots 24 and 26 which extend inwardly from opposite side walls, generally indicated by 28 and 30 respectively, of the pivot rod pad, with slots 24 and 26 being disposed in spaced parallelism to a forward wall 32 of forward portion 18.

Intermediate portion 20 of pivot rod pad 10 is separated from rearward portion 22 by a second pair of axially aligned slots 34 and 36 which extend inwardly from side walls 28 and 30 respectively in spaced parallelism to the first pair of slots 24 and 26 and in spaced parallelism to a rearward wall 38 of rearward portion 22.

The slots 24 and 34 which extend inwardly from sidewall 28 define a first resilient finger 40, located at one end of intermediate portion 20, while slots 26 and 36 which extend inwardly from sidewall 30 define a second resilient finger 42, located at the opposite end of intermediate portion 20.

Figure 2:
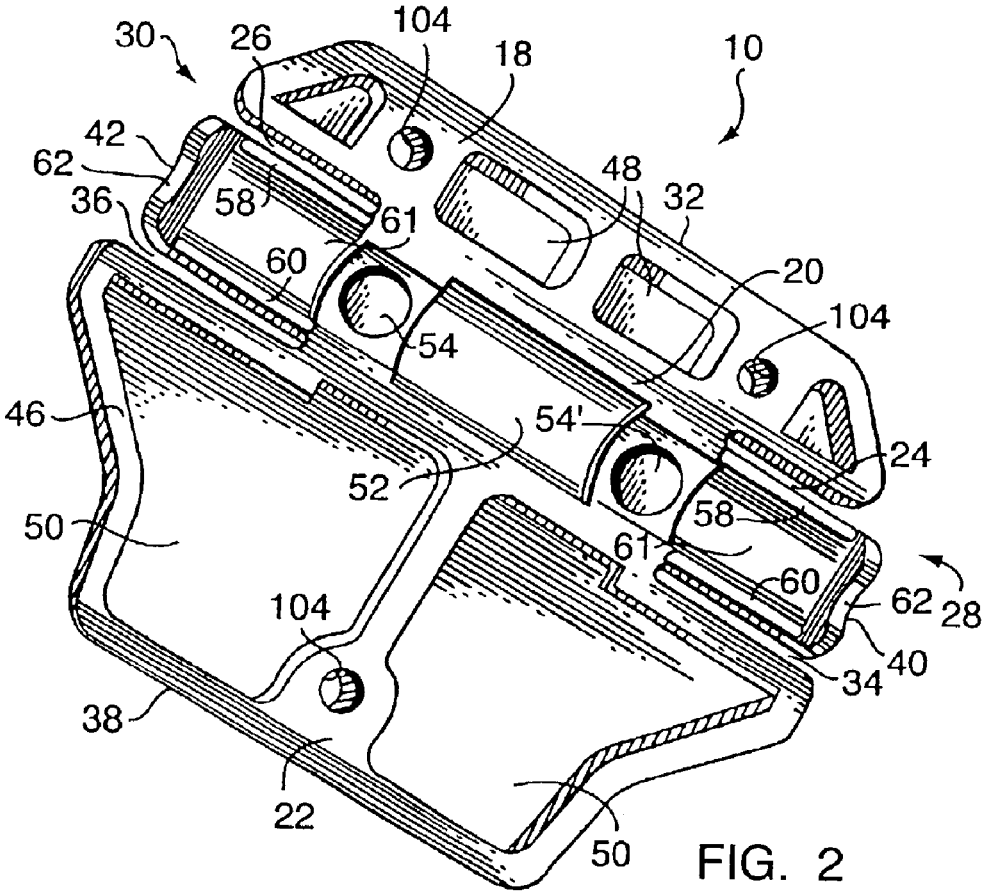
FIG. 2 is a bottom perspective view of the snowshoe pivot axle pad of FIG. 1.
Figure 3:
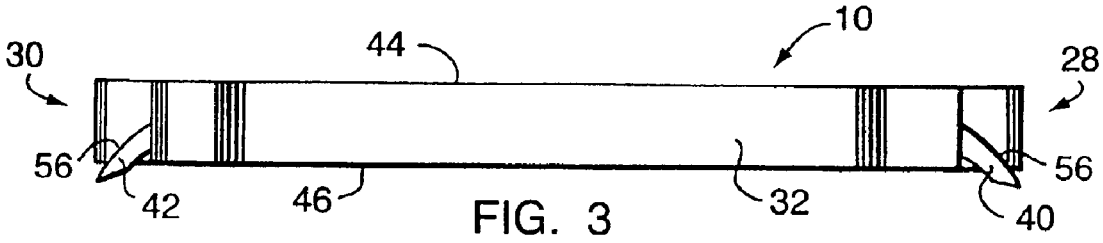
FIG. 3 is a front elevational view of the snowshoe pivot axle pad as seen from the left of FIG. 1.
Figure 4:
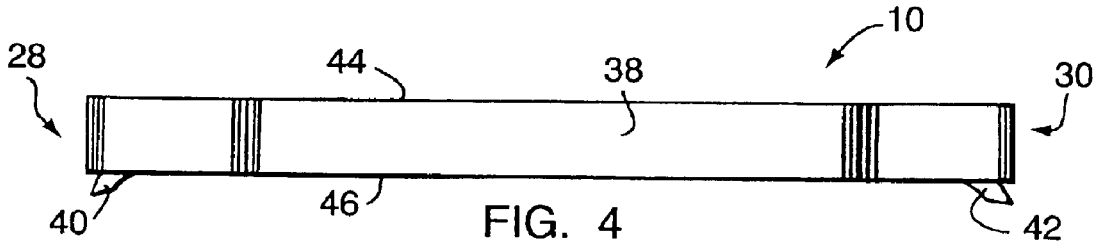
FIG. 4 is a rear elevational view of the pivot axle pad as seen from the right of FIG. 1.
Figure 5:
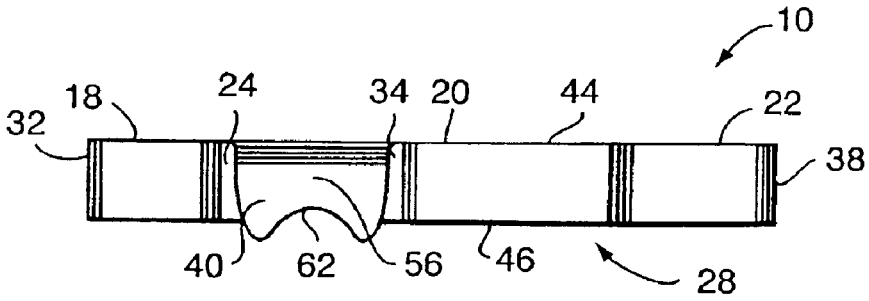
FIG. 5 is a side elevational view of the pivot axle pad of FIG. 1, the opposite side being a mirror image.
Figure 6:
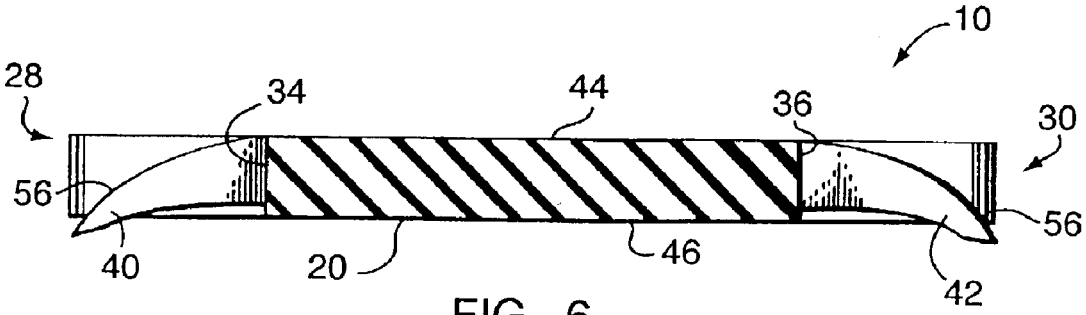
FIG. 6 is a cross-sectional view taken of line 6—6 of FIG. 1.

As best seen in FIGS. 1 and 2, pivot rod pad 10 has a flat upper face 44 and a contoured lower face 46.

The lower surface of forward portion 18 of pivot rod pad 10 lower face 46 is cut away or relieved to provide a series of spaced, aligned grooves 48, while the lower surface of rearward portion 22 is cut away or relieved to provide a pair of side-by-side recesses 50.

The lower surface of intermediate portion 20 of pivot rod pad 10 is cut away or relieved to provide a centrally located, longitudinally-extending, groove 52 and a pair of spaced, reliefs 54 and 54', with one such relief being disposed at each end of groove 52.

The lower faces of each resilient finger 40 and 42 are identical to each other, with each finger including a downwardly curved outer end 56 and a pair of spaced, parallel ribs 58 and 60 which depend from each finger and extend inwardly from the outer end 56 of each finger.

Ribs 58 are disposed adjacent slots 24 and 26 which separate fingers 40 and 42 from pivot rod pad forward portion 18, while ribs 60 are disposed adjacent slots 34 and 36 which separate fingers 40 and 42 from pivot rod pad rearward portion 22.

Ribs 58 and 60 define a longitudinally-extending, channel 61 on the lower surface of each finger 40 and 42, with the channel 61 of each finger being axially aligned with groove 52 of intermediate portion 20.

The lower faces of outer ends 56 of fingers 40 and 42 are each provided with a cutout 62, for purposes to appear.

The several grooves, recesses, reliefs and channels in contoured lower face 46 of pivot rod pad 10 contribute to the resilience of the pad, reduce its weight and permit mating of the pad with pivot rod assembly 12, as will appear.

Figure 12:
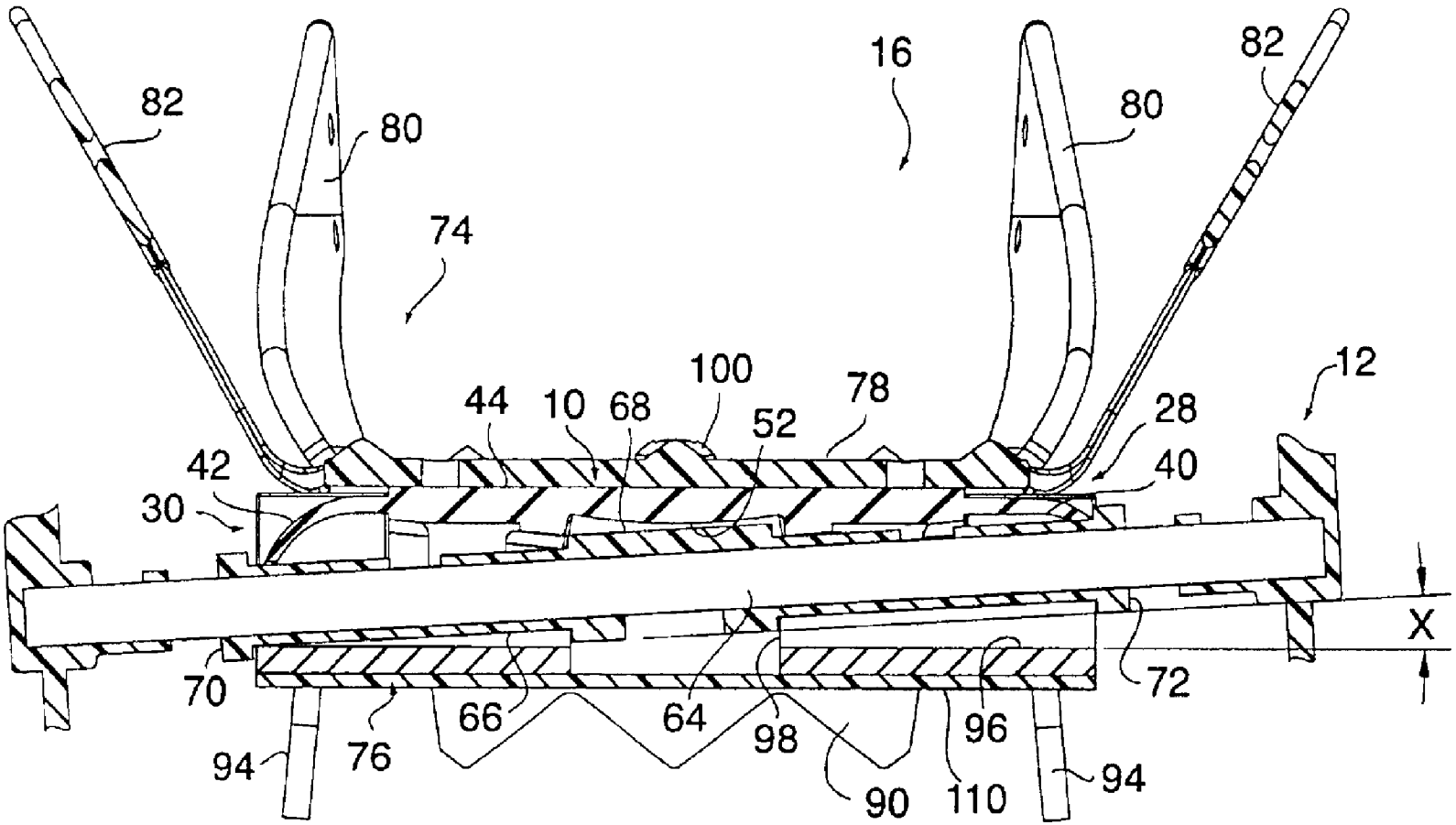
FIG. 12 is a cross-sectional view taken on line 12—12 of FIG. 11, with the pivot axle assembly being disposed at a frontal plane angle of rotation of 3.25 degrees.

Pivot rod assembly 12, which is best seen in FIGS. 9 and 12, is molded integrally with snowshoe 14 and is disposed approximately centrally of and extends transversely across an elliptically-shaped opening 63 provided adjacent the forward end of the snowshoe.

It must be noted that the pivot rod pad 10 of the invention may be used with other than molded snowshoes.

Pivot rod pad 10 may be used with snowshoes fabricated from wood, metal, thermoplastic or composites of those materials.

Pivot rod assembly 12 includes a rod 64 which is encased in a sleeve 66 having bosses 70 and 72 at its opposite ends, with each boss being formed integrally with and extending inwardly from an adjacent side wall of opening 63 in snowshoe 14.

Sleeve 66 has a raised, longitudinally extending hub 68 located centrally of its length.

Pivot rod assembly 12 need not be formed integrally with snowshoe 14; it may be formed as a separate member, which is fixed to the snowshoe.

Rod 64 and sleeve 66 of pivot rod assembly 12 may be other than the circular cross-sectional shape as shown in the drawings and may also comprise a single unitary member.

In use, pivot rod pad 10 is positioned so as to rest on pivot rod assembly 12, with centrally-located hub 68 of sleeve 66 of the pivot rod assembly being snugly receivable in centrally-located groove 52 provided in lower face 46 of intermediate portion 20 of the pivot rod pad, while bosses 70 and 72 of sleeve 66 of the pivot rod assembly serve as stops for the outer ends 56 of fingers 40 and 42 of the pivot rod pad, as will appear.

Figure 10:
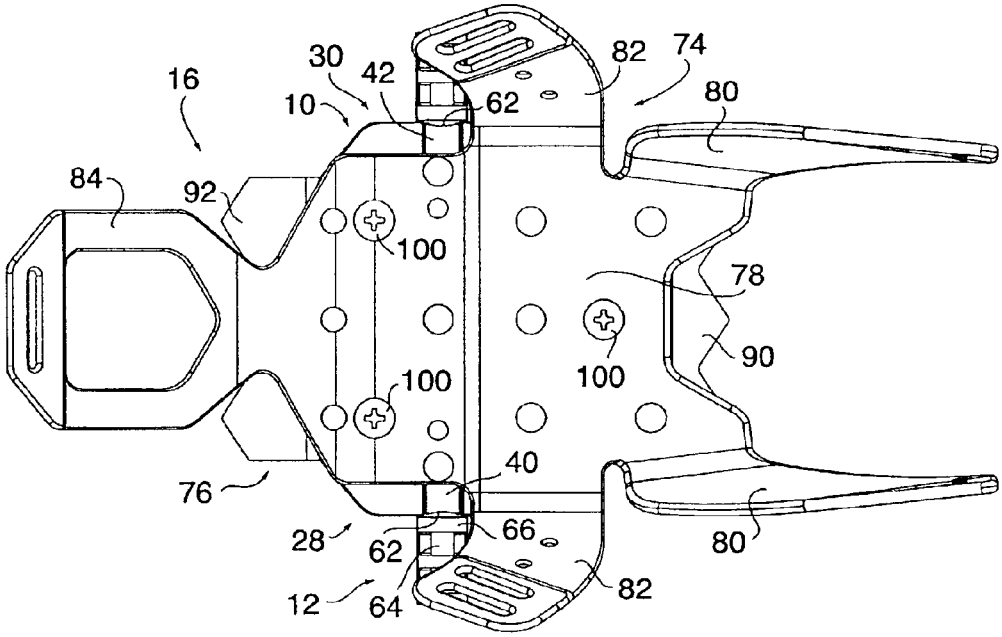
FIG. 10 is an enlarged, top plan view of the snowshoe binding assembly of the snowshoe of FIG. 7, with the binding straps and the snowshoe frame omitted for clarity of illustration.
Figure 11:
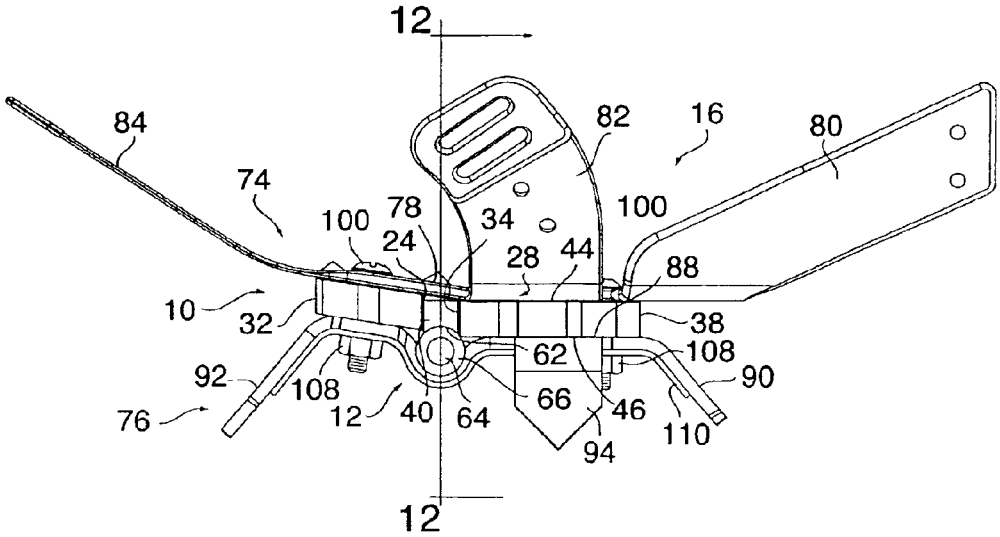
FIG. 11 is a side elevational view of the snowshoe binding assembly of FIG. 10.

As best seen in FIGS. 10 and 11, snowshoe binding assembly 16 includes pivot rod pad 10, a boot housing, generally indicated by 74 positioned above the pivot rod pad, and a toe crampon, generally indicated by 76, positioned below the pivot rod pad.

Boot housing 74 is preferably fabricated as an integral unit from a sturdy thermoplastic material and includes a flat base 78 having a pair of spaced, wing-like heel members 80 extending rearwardly and upwardly from a rear edge thereof, a pair of spaced, centrally-located, finger-like instep members 82 extending upwardly from the side edges thereof, and a centrally-located toe member 84 extending forwardly and upwardly from a front edge thereof.

Figure 7:
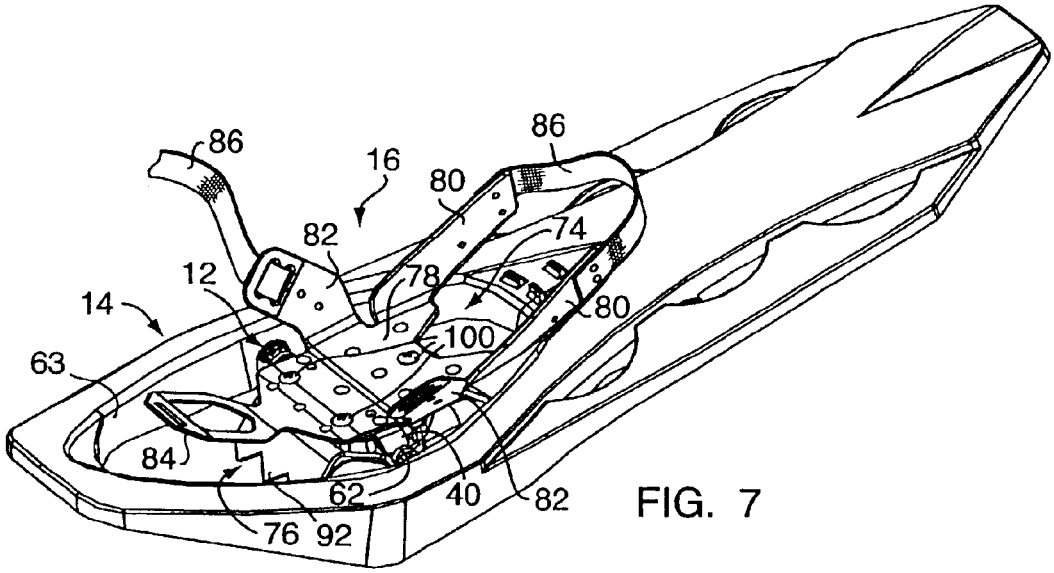
FIG. 7 is a top perspective view of a snowshoe incorporating the pivot axle pad of FIGS. 1–6.

A system of straps 86, best seen in FIG. 7, extends between heel members 80, instep members 82 and toe member 84 for firmly holding a user's boot in place in boot housing 74.

Toe crampon 76 is preferably formed as an integral unit from metal and includes a substantially flat base 88 having a first trio of teeth 90 depending angularly rearwardly from its rear edge, a second trio of teeth 92 extending angularly downwardly and forwardly from its forward edge and a pair of spaced teeth 94, each of which extends downwardly from an opposite side edge of base 88 immediately forwardly of the first trio of teeth 90.

Base 88 of crampon 76 has a centrally located channel or groove 96 formed therein and extending transversely thereacross.

A transversely extending opening 98, best seen in FIGS. 12 and 15, is provided centrally of groove 96 in base 88.

Groove 96 of crampon 76 is of appropriate size, location and configuration to receive pivot rod assembly 12 therein.

Opening 98 of groove 96 is of appropriate size, location and configuration to receive central hub 68 of sleeve 66 of pivot rod assembly 12 therein, whereby free forward and rearward pivotal movement of crampon 76 relative to pivot rod assembly 12 is permitted.

Boot housing 74 of snowshoe binding assembly 16 is secured to pivot rod pad 10 and to crampon 76 as by screws or bolts 100 which extend through aligned openings 102, 104 and 106 provided in base 78 of boot housing 74, in pivot rod pad 10 and in base 88 of crampon 76 respectively, the screws or bolts 100 having nuts 108 threaded thereon.

Figure 8:
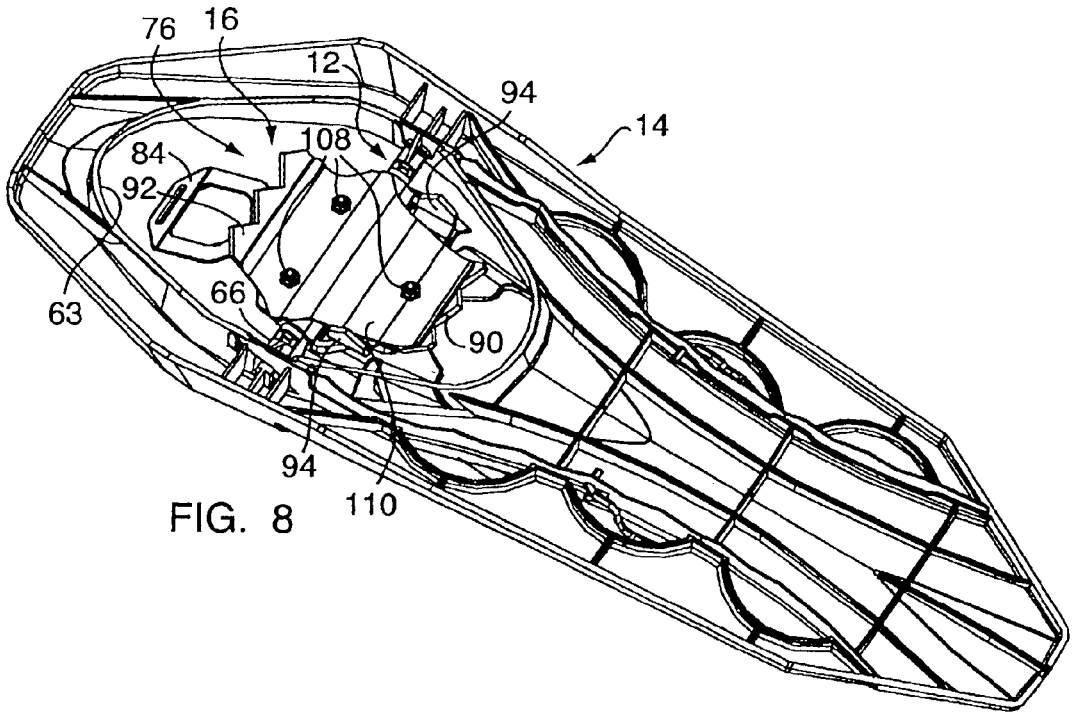
FIG. 8 is a bottom perspective view of the snowshoe of FIG. 7.

As seen in FIGS. 8 and 15, a snowshield member 110 is positioned against the lower face of crampon 76 and is held in place by the screws or bolts 100 which extend through provided openings in the snowshield, with the nuts 108 embracing the lower face of the snowshield.

Snowshield member 110 is preferably fabricated from a sturdy thermoplastic material and helps to preclude snow from packing into crampon 76.

As best seen in FIG. 15, boot housing 74 of snowshoe binding assembly 16 and pivot rod pad 10 are positioned above pivot rod assembly 12, while crampon 76 is positioned below the pivot rod assembly. The assembled unit permits both limited front to rear pivotal movement and side to side pivotal movement of the binding assembly and pivot rod pad.

Figure 13:
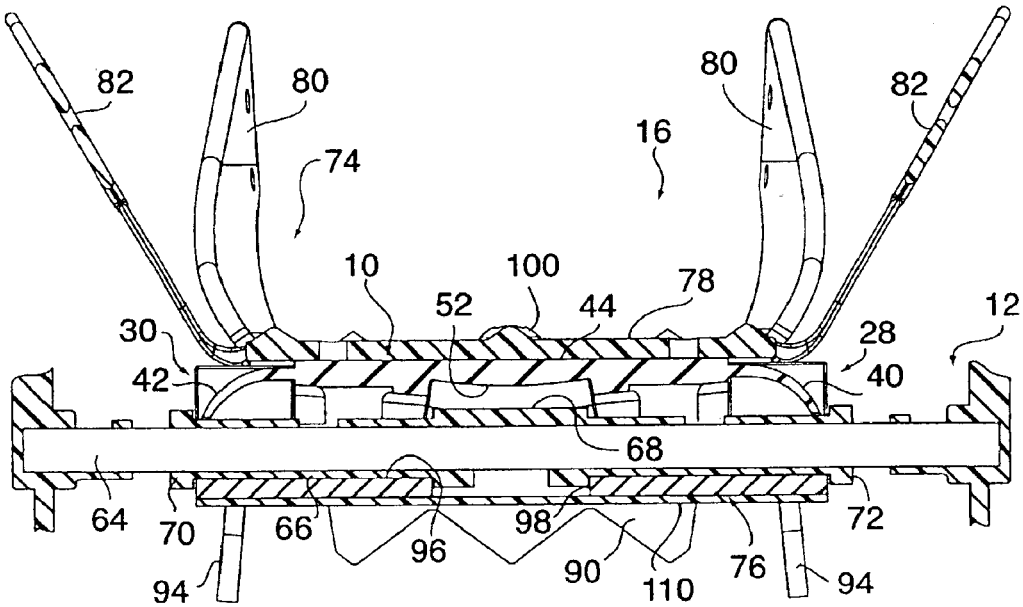
FIG. 13 is a cross-sectional view similar to FIG. 12 illustrating the relationship of the pad of the invention and the pivot axle assembly without weight on the snowshoe binding.

FIG. 13 of the drawings shows the relative positions of snowshoe binding assembly 16, pivot rod pad 10 and crampon 76 when the snowshoe is not in use, with no weight being placed on boot housing 74.

Figure 14:
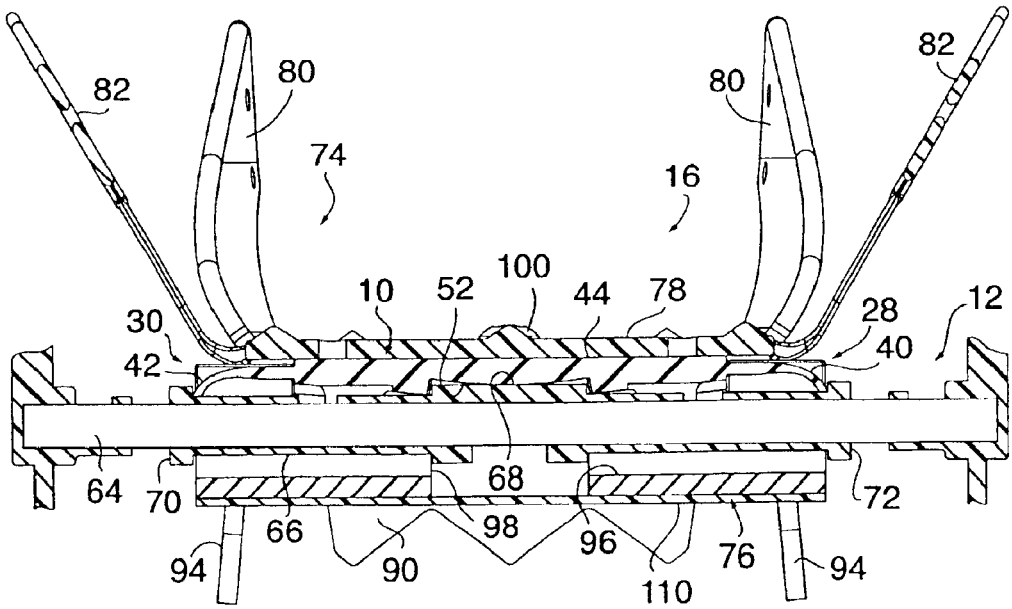
FIG. 14 is a cross-sectional view similar to FIG. 12 illustrating the relationship of the pad of the invention and the pivot axle assembly when weight is placed on the snowshoe binding assembly.

FIG. 14 shows the relative positions of those components when the snowshoe is in use, with weight being placed on boot housing 74 by a user.

When the snowshoe is unweighted, as in the position of FIG. 13, it will be noted that only fingers 40 and 42 of intermediate portion 20 of pivot rod pad 10 are in contact with sleeve 66 of pivot rod assembly 12.

When the snowshoe is weighted, as in the position of FIG. 14, it will be noted that not only do fingers 40 and 42 of intermediate portion 20 of the pivot rod pad contact sleeve 66 of pivot rod assembly 12, but central hub 68 of sleeve 66 is now engaged in central groove 52 of intermediate portion 20.

In such weighted condition, pivot rod pad 10 permits frontal plane, or side-to-side rotation. In FIG. 12, a frontal plane angle of rotation X of 3.25° is achieved. Such angularization is permitted by the flexing of resilient finger 40 of intermediate portion 20 of pivot rod pad 10.

While a frontal plane angle of rotation of 3.25° is illustrated in FIG. 12, it will be understood that rotation angles of varying degrees can be achieved with the pivot rod pad of the invention.

What is claimed is:

1. A snowshoe comprising, a frame, a pivot axle fixed to and extending transversely across an opening in the frame, and a binding assembly mounted in the opening comprising, a boot housing, a resilient pad and a toe crampon disposed in a stacked relation and means interconnecting the boot housing, resilient pad and toe crampon, the resilient pad having a contoured lower surface and spaced, resilient fingers formed integrally therewith, the resilient pad being positioned below the boot housing, the contoured lower surface of the resilient pad being in contact with the pivot axle and permitting sagittal plane, front to rear rotation of the boot housing relative to the pivot axle, the spaced, resilient fingers of the resilient pad having free ends in contact with the pivot axle, the toe crampon being positioned below and in contact with the pivot axle, the resilient fingers of the resilient pad flexing under applied pressure from the boot housing for permitting frontal plane, side to side rotation of the binding assembly relative to the pivot axle.

2. In a snowshoe according to claim 1, wherein the pivot axle is encased in a sleeve which is fixed thereto, the sleeve having a contoured peripheral face for mating engagement with the contoured lower surface of the resilient pad.

3. In a snowshoe according to claim 2, including stop means on the contoured peripheral face of the pivot axle sleeve for limiting the flexing movement of the resilient fingers of the resilient pad.

4. In a snowshoe according to claim 1, wherein the toe crampon has a channel extending transversely thereacross, with the pivot axle being disposed in said channel.

5. In a snowshoe according to claim 1, wherein the boot housing, resilient pad and toe crampon are substantially coextensive with each other in transverse width.

6. In a snowshoe according to claim 1, wherein the resilient pad comprises integral, contiguous, forward, intermediate and rearward portions, with the resilient fingers of the resilient pad being located in the intermediate portion.

* * * * *